US005248192A

United States Patent [19]

Tazzia

[11] Patent Number: 5,248,192

[45] Date of Patent: Sep. 28, 1993

[54] DESK TOP EXTENSION DEVICE

[75] Inventor: Peter L. Tazzia, Grosse Pointe, Mich.

[73] Assignee: Peter Tazzia, Grosse Pointe, Mich.

[21] Appl. No.: 828,351

[22] Filed: Jan. 30, 1992

[51] Int. Cl.[5] ..... A47B 27/00

[52] U.S. Cl. ..... 312/194; 312/208.1

[58] Field of Search ..... 312/194, 196, 312, 208.1, 312/21, 314

[56] References Cited

U.S. PATENT DOCUMENTS

| | | | |
|---|---|---|---|
| 2,401,181 | 5/1946 | Paxton et al. | 312/208.1 |
| 2,511,919 | 6/1950 | Jones et al. | 312/208.1 |
| 2,533,155 | 12/1950 | Von Hacht | 312/194 |
| 2,588,844 | 8/1952 | Jones et al. | 312/208.1 |
| 2,676,860 | 4/1954 | Lemds | 312/208.1 |
| 2,832,658 | 4/1958 | Bullock | 312/194 |
| 3,356,430 | 12/1967 | Schreyer | 312/208.1 |
| 3,517,625 | 6/1970 | Swett . | |
| 3,711,174 | 1/1973 | Davis et al. . | |
| 4,781,126 | 11/1988 | Lochridge . | |
| 4,802,714 | 2/1989 | Steinhilber . | |
| 4,944,235 | 7/1990 | Jahnke et al. . | |

FOREIGN PATENT DOCUMENTS 3440974 5/1986 Fed. Rep. of Germany ..... 312/194

*Primary Examiner*—Victor N. Sakran

*Attorney, Agent, or Firm*—Keefe & Associates

[57] ABSTRACT

A desk top extension device which readily increases the work area of a desk without need for any modification to the desk is structured for being used in conjunction with a partially opened uppermost desk drawer and is composed, in essence, of a substantially rectangularly shaped base member and an interconnection system composed of an extension member and an abutment member connected thereto. In operation, the topmost desk drawer is partly pulled out and the extension member is inserted into the desk drawer on an angle then horizontally oriented so that the abutment member is located within the desk drawer abutably against the desk frame. Thusly, the base member rests upon the front top edge of the drawer and the abutment member holds the desk top extension device from tipping and moving outwardly from the desk. A book rest member may be connected with the base member for holding reading material in a comfortable orientation for reading thereof by the desk user.

19 Claims, 2 Drawing Sheets

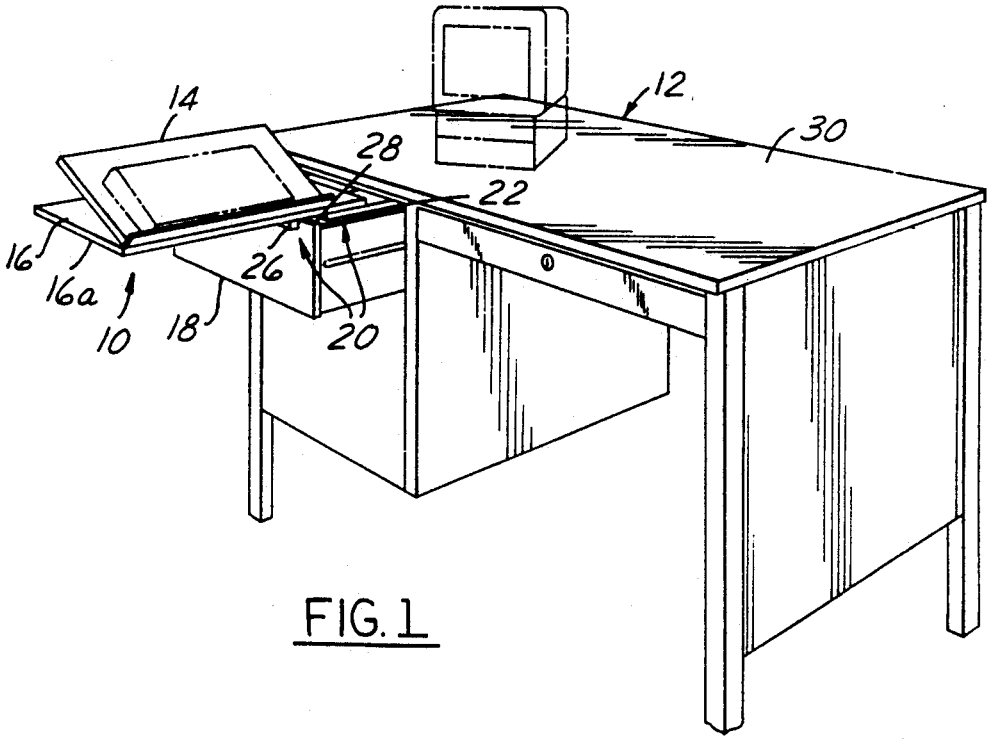
FIG. 1
FIG. 2
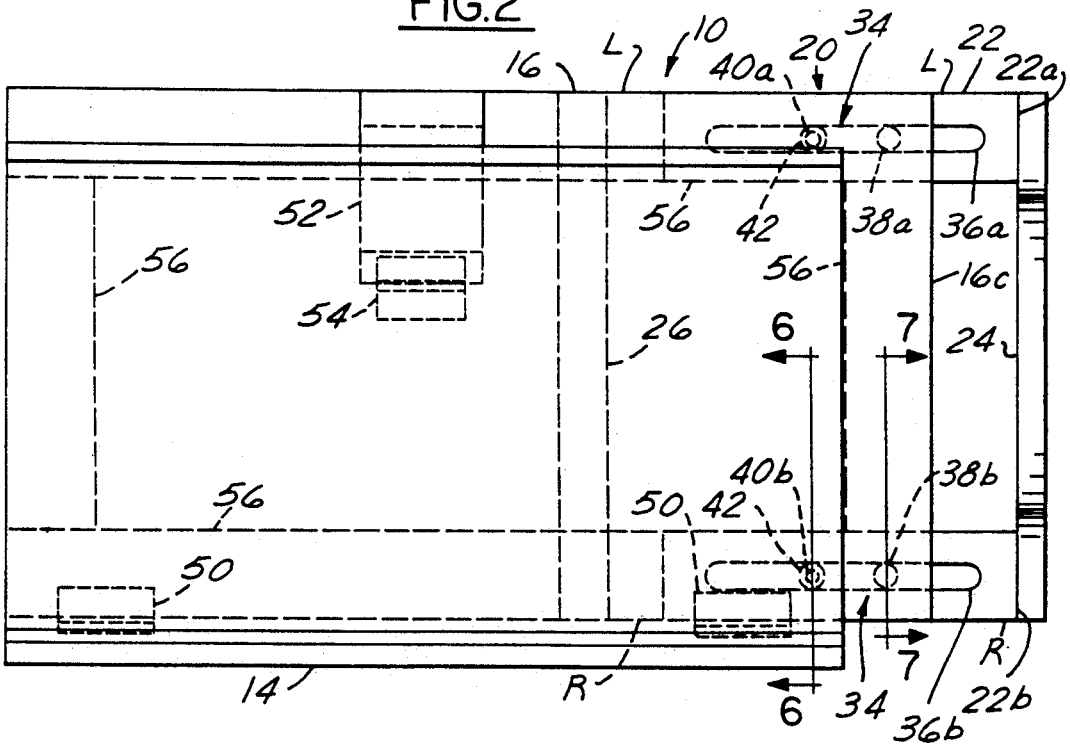

DESK TOP EXTENSION DEVICE

BACKGROUND OF THE INVENTION

1. Field of the invention

The present invention relates to desks, and more particularly to leaf extensions for a desk conventionally located above the drawers thereof. Still more particularly, the present invention relates to a removable work surface which is located upon the uppermost desk drawer and is held in position by connection with respect to the desk frame.

2. Description of the Prior Art

A universal wish of all desk users is to have more usable work surface area. Today, this is even more desirable because of the proliferation of electronic devices that now have found their way to indispensible status in the office and occupy a large proportion of the desk top.

One solution that is old in the art is to provide an extension leaf which slidably connects with the desk just above the topmost desk drawer. While this device is quite effective at providing extra desk top area when needed, unfortunately many desks do not have this feature built-in.

Accordingly, what is needed in the art is to provide a way to selectively increase desk top area for any desk whether or not it is equipped with a built-in extension leaf.

SUMMARY OF THE INVENTION

The present invention is a desk top extension device which readily increases the work area of a desk without need for any modification to the desk.

The desk top extension device according to the present invention is structured for being used in conjunction with a partially opened uppermost desk drawer and is composed, in essence, of a substantially rectangularly shaped base member and an interconnection system composed of an extension member and first and second abutment members. The first abutment member is located at one end of the extension member, and the second abutment member is located at a preselected location on the base member.

In operation, the topmost desk drawer is partly pulled out and the extension member is inserted into the desk drawer on an angle then horizontally oriented so that the first abutment member is located within the desk drawer abutably against the desk frame. The drawer is then opened further until the front face of the desk drawer abuts the second abutment member while the base member rests upon the front top edge of the topmost desk drawer so that the first and second abutment members collectively hold the desk top extension device from moving in the horizontal plane with respect to the desk.

In a preferred embodiment, a book rest member is hingably connected with the base member for holding reading material in a comfortable orientation for reading thereof by the desk user.

Accordingly, it is an object of the present invention to provide a desk top extension device for adding usable work surface to the desk, and which is applicable to any desk.

It is an additional object of the present invention to provide a desk top extension device which interfaces with the topmost desk drawer of a desk, and which is supported and anchored by interconnection with respect to the topmost desk drawer and the desk frame.

It is another object of the present invention to provide a desk top extension device which features a book rest member for holding reading materials at a preselected angle for comfortable reading by the desk user.

These, and additional objects, advantages, features and benefits of the present invention will become apparent from the following specification.

BRIEF DESCRIPTION OF THE DRAWINGS

FIG. 1 is a perspective view of the desk top extension device according to the present invention shown in operation with respect to a desk, the embodiment depicted including a book holder.

FIG. 2 is a top plan view of the desk top extension device shown in FIG. 1.

DETAILED DESCRIPTION OF THE PREFERRED EMBODIMENT

Figure 3:
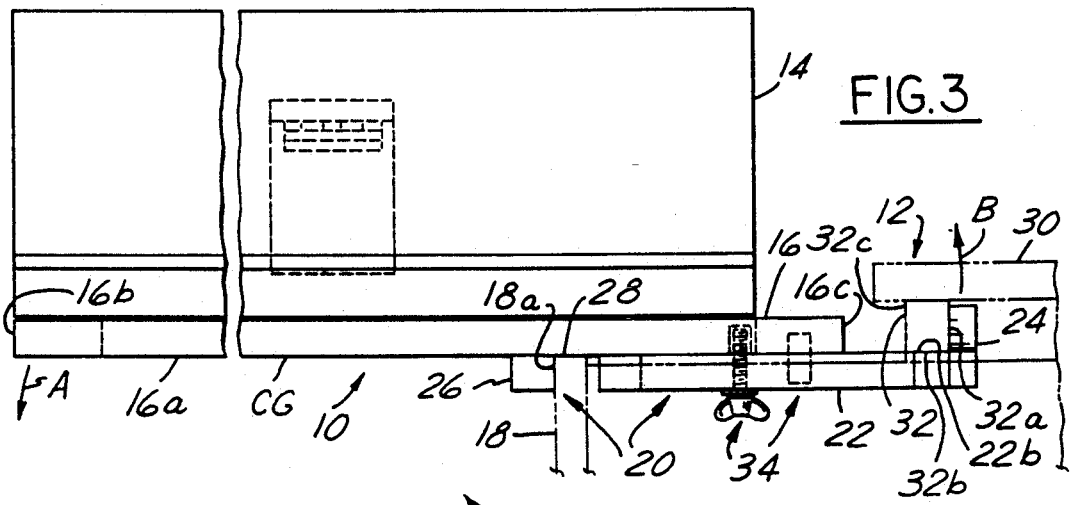
FIG. 3 is a side view of the desk top extension device shown in FIG. 1, detailing a preferred interconnection system for connecting the desk top extension member with the desk.
Figure 4:
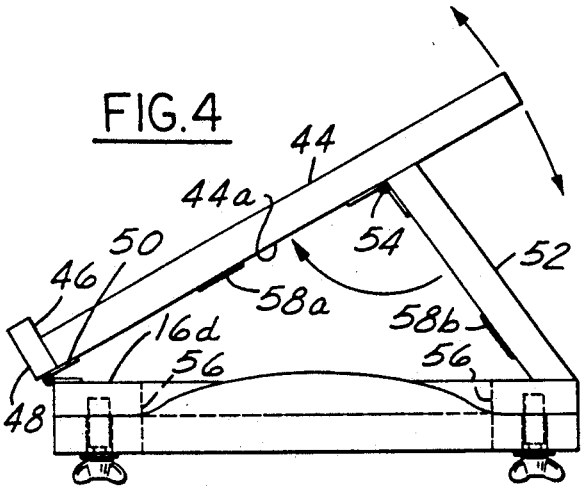
FIG. 4 is an end view of the desk top extension device shown in FIG. 1, showing the book holder in the operational configuration.
Figure 6:
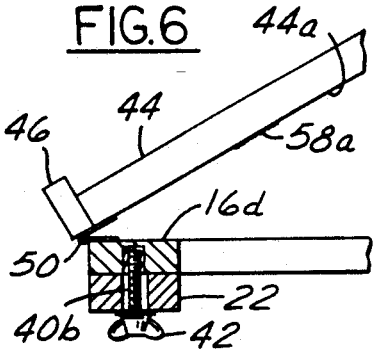
FIG. 6 is a partly sectional detail view of the desk top extension device as seen along lines 6—6 in FIG. 2.
Figure 5:
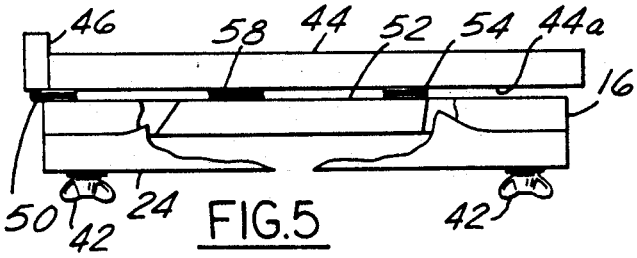
FIG. 5 is a partly fragmentary end view of the desk top extension device as shown in FIG. 4, now showing the book holder in the storage configuration.
Figure 7:
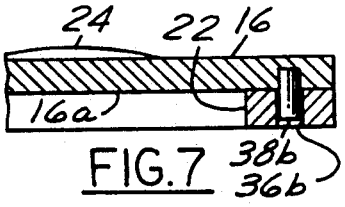
FIG. 7 is a partly sectional detail view of the desk top extension device as seen along lines 7—7 in FIG. 2.

Referring now to the Drawing, FIG. 1 shows an operational view of the desk top extension device 10 according to the present invention. The desk top extension device 10 is removably connected with a desk 12 in a manner which provides additional desk top space, and which may, as depicted in FIG. 1, provide a book holder 14 that is hingably connected to a base member 16. As can be discerned from FIG. 1, the desk top extension device 10 is located relative to the desk so as to rest upon a partially opened uppermost desk drawer 18, the uppermost desk drawer serving as the support for the desk top extension device. Also discernable from FIG. 1, is an interconnection system 20, connected with the base member 16, which interfeaces with the desk 12 so as to keep the desk top extension device 10 held in a fixed position relative to the horizontal plane. The interconnection system 20 includes, in essence, an extension member 22 connected to the bottom side **16*a* of the base member 16, the extension member having an upper side 22*b* oriented in parallel alignment with respect to the bottom side 16*a*, and a first abutment member 24 located at a remote end 22*a* of the extension member at a perpendicular orientation with respect thereto. It is further preferred for the interconnection system 20 to include a second abutment member 26 connected with the bottom side 16*a* of the base member 16. It is preferred for the base member 16 to have a width and length approximately on the order of the desk drawer, but this is not a requirement. The dimensions of the extension member 22 and the first abutment member 24 are such as to permit insertion thereof into the drawer 18**. In the event the base member is constructed of wood, a preferred thickness is on the order of one-half inch; a finish reasonably matching that of the desk is also preferred, but again this is not a requirement. Specific embodimental details will now be discussed with particular reference being made to the Drawing.

FIGS. 2 and 3 depict a preferred interconnection system 20 for the desk top extension device 10 relative to the desk 12. The interconnection system 20 is connected with the base member 16 so that the bottom side 16*a* of the base member is able to rest upon the top front edge 28 of the desk drawer 18 and be held in a fixed position in the horizontal plane, the horizontal being defined by the desk top 30. This is accomplished a substantial portion of the base member 16 overhanging the top front edge 28 of the desk drawer 18, while the first abutment member 24 abuts the inner side 32*a* of the upper drawer frame member 32 of the desk 12, and while the upper surface 22*b* of the extension member 22 abuts the under side 32*b* of the upper drawer frame member. In this configuration, the location of the center of gravity CG of the desk top extension device 10 is located between the outer end 16*b* of the base member and the top front edge 28 of the drawer 18. This location of the center of gravity CG results in the desk top extension device 10 being unbalanced upon the top front edge 28 so that the outer end 16*b* of the base member 16 tends to tilt downward along arrow A, while the first abutment member 24 tends to tilt upward along arrow B to thereby hold the first abutment member 24 adjacent the inner side 32*a* of the upper drawer frame member 32 and to thereby retain the extension member 22 in a horizontal attitude by abutment of the upper side 22*b* thereof with the under side 32*b* of the upper drawer frame member 32. The more the center of gravity is shifted toward the outer end 16*b* of the base member 16, the less likely the extension member 22 and associated first abutment member 24 will dislodge from the upper drawer frame member 32 during use of the desk top extension device 10.

Because the dimensions of upper drawer frame members vary from desk to desk, it is preferred to include an adjustment mechanism 34 which allows for these variations. The adjustment mechanism 34 serves to permit the location of the first abutment member 24 to be adjustable relative to the second abutment member 26, wherein the second abutment member may be optionally the inner end 16*c* of the base member 16. It is preferred that the distance of separation between the inner end 16*c* of the base member 16 and the first abutment member 24 to be adjusted so as to be approximately that of the width (between the outer side 32*c* and inner side 32*a*) of the upper drawer frame member 32 as may pertain to a particular desk. With this geometry, the desk surface extension device 10 is held in a horizontally fixed position by opposing abutment of each of the inner end 16*c* (which here serves in the role of a second abutment member) and first abutment member 24 with respect to the upper drawer frame member 32.

To carry-out the aforesaid adjustability function, a preferred structure for an adjustment mechanism 34 is shown in FIGS. 2, 3, 6 and 7. An elongate slot 36*a*, 36*b* is provided at each side L, R of the extension member 22 with an orientation perpendicular to the first abutment member 24. A peg 38*a*, 38*b* is provided at each side L, R of the bottom side 16*a* of the base member adjacent the inner end 16*c* thereof. A threaded shank 40*a*, 40*b* is provided at each side L, R of the bottom side 16*a* of the base member in alignment with and spaced from the peg on that respective side of the base member. Each peg and threaded shank on each side L, R of the bottom side 16*a* of the base member inserts into a respective slot; thus, threaded shank 40*a* and peg 38*a* insert into slot 36*a*, while threaded shank 40*b* and peg 38*b* insert into slot 36*b*. Wing nuts 42 thread onto the threaded shanks 40*a*, 40*b*. The extension member 22 may be slid along the slots 36*a*, 36*b* as long as the wing nuts 42 remain untightened on their respective threaded shanks 40*a*, 40*b*. Of course, other adjustment mechanisms 34 may become apparent to those of ordinary skill in the art, and such adjustment mechanisms are considered within the scope of the present invention, as defined by the appended claims.

Referring now to FIGS. 3 through 6, the structure of the optional book holder 14 will be detailed. The book holder 14 is composed generally of a flat book rest member 44 having a lip 46 running along the bottom 48. The bottom 48 is defined by a hinged connection 50 of the book rest member 44 to the top side 16*d* of the base member 16 adjacent one side L, R thereof. In order to hold the book rest member 44 at a predetermined angle (or at a user selected angle) a support member 52 is employed, which is connected by a hinge 54 to the bottom side 44*a* of the book rest member 44 at a location spaced from the hinged connection 50. In the operational configuration shown in FIG. 4, the book rest member 44 is held at the aforesaid angle by the support member 52 being held supported against the top side 16*d* of the base member 16. In order to facilitate collapse of the book rest member 44 to the storage configuration shown in FIG. 5 in which the book rest member 44 is oriented parallel with the horizontal plane, a cutout 56 is provided in the base member 16 to accommodate the support member 52 being received thereinto. In order to conveniently hold the support member 52 in adjacency to the bottom side 44*a* of the book rest member 44, a releasable fastener 58 is used, such as one having a hook portion 58*a* which interfaces with a loop portion 58*b*.

Now with respect to the foregoing description and FIGS. 1 through 7, operation of the invention will be elaborated. The desk drawer is pulled out from the desk part way, typically on the order of about one-fifth the way. The desk top extension device is then handled so as to insert the first abutment member on a downward angle with respect to the horizontal into the desk drawer. The interconnection system is then implemented as follows. The adjustment mechanism is used to positively locate the first abutment member so that it abuts the inner side of the upper drawer frame member of the desk. Then, either adjustment is made so that the inner end of the base member (serving in the capacity of a second abutment member) abuts the outer side of the upper drawer frame member, or else adjustment is made so that the top front edge of the drawer is moved so that the front of the drawer abuts the second abutment member. In this configuration, the top front edge of the drawer supports the desk extension device, while movement thereof in the horizontal plane and rotation thereof about the top front edge of the drawer are both prevented by operation of the interconnection system abutting the desk. The desk top extension member may then be easily removed by tilting downward the first abutment member until it clears the upper drawer frame member, and the desk top extension member is then removed from the drawer. Replacement of the desk top extension device is now easy, as the adjustment mechanism should not need to be again resorted to.

Figure 8:
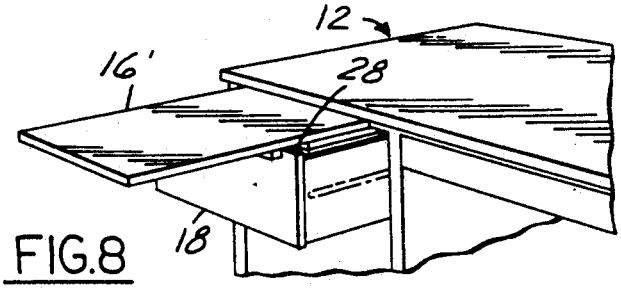
FIG. 8 is a perspective view of the desk top extension device according to the present invention shown in operation with respect to a desk, the embodiment depicted providing a flat work surface.

FIG. 8 depicts a variation in the desk top extension member 10 in which the book holder is not present, and the base member 16' forms a continuous surface somewhat similar to a conventional sliding desk extension leaf.

Figure 9:
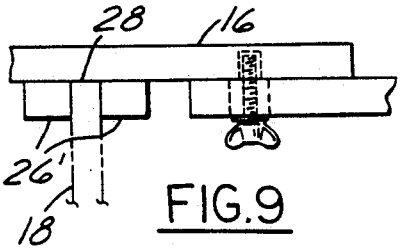
FIG. 9 is a side view of the desk top extension device according to the present invention, detailing another preferred interconnection system for connecting the desk top extension member with the desk.

FIG. 9 depicts an alternative second abutment member 26', in which a space is provided into which is abutably located the top front edge 28 of the drawer 18.

To those skilled in the art to which this invention appertains, the above described preferred embodiment may be subject to change or modification. For instance, any and all variations of the invention discussed hereinabove may be selectively combined as desired for a particular application. Further, while the desk top extension device according to the present invention has been described in use with the topmost desk drawer, this is not a requirement, as the desk top extension device will work with other than the topmost drawer, as a conventional desk has an upper drawer frame member above each drawer. Finally, while it is preferred to include the first and second abutment members (the second abutment member being either a separate structure connected with the base member or the inner end of the base member), the desk top extension device according to the present invention can be constructed and operate with one, both or none of them. Such change or modification can be carried out without departing from the scope of the invention, which is intended to be limited only by the scope of the appended claims.

What is claimed is:

1. A desk top extension device for being removably connected to a desk, the desk having at least one drawer, the desk further having an upper drawer frame member located immediately above the at least one drawer, the upper drawer frame member having an under side, an outer side, and an inner side, the at least one drawer having a width, a front, and a top front edge, the desk further having a top surface defining horizontal, said desk top extension member comprising:

a base member, said base member having an outer end and an inner end, said base member further having a bottom side; and an interconnection system for removably connecting the base member with respect to the desk, said interconnection system comprising:

an extension member connected to said base member and projecting from said inner end thereof, said extension member having a remote end spaced from said inner end of said base member, said extension member having an upper side, said extension member being connected with said base member so that said upper side of said extension member is substantially aligned with respect to said bottom side of said base member;

wherein said extension member has a width less than the width of the drawer so that said extension member is insertable into the drawer; wherein further said base member and said extension member are dimensioned so that when the drawer is partly opened with respect to the desk said extension member is inserted into the drawer so that said upper side of said extension member abuts the under side of the upper drawer frame member, while simultaneously said bottom side of said base member rests upon the top front edge of the drawer, whereupon said base member is oriented in a plane substantially parallel with respect to the horizontal.

2. The desk top extension device of claim 1, further comprising book holder means connected with said base member for holding a book at a selected angle for reading thereof.

3. The desk top extension device of claim 2, wherein said interconnection system further comprises abutment means connected with at least one of said base member and said extension member for holding said base member in a selectively fixed position relative to the desk in said plane.

4. The desk top extension device of claim 1, wherein said interconnection system further comprises abutment means connected with at least one of said base member and said extension member for holding said base member in a selectively fixed position relative to the desk in said plane.

5. The desk top extension device of claim 1, wherein said interconnection system further comprises a first abutment member connected with said remote end of said extension member, said first abutment member being structured to abut the inner side of the upper drawer frame member when said upper side of said extension member abuts the under side of the upper drawer frame member so as to prevent said base member from being moved in said plane outwardly from the desk.

6. The desk top extension device of claim 5, wherein said interconnection system further comprises a second abutment member connected with said base member, said second abutment member being structured to abut the outer side of the upper drawer frame member when said upper side of said extension member abuts the under side of the upper drawer frame member so as to prevent said base member from being moved in said plane inwardly toward the desk.

7. The desk top extension device of claim 6, wherein said first abutment member is located with respect to said second abutment member so that simultaneously said first abutment member substantially abuts the outer side of the upper drawer frame member when said second abutment member substantially abuts the inner side of the upper drawer frame member so as to prevent said base member from being moved in said plane with respect to the desk.

8. The desk top extension device of claim 7, wherein said interconnection system further comprises first abutment member adjustment means connected with said extension member for selectively locating said first abutment member with respect to said second abutment member.

9. The desk top extension device of claim 6, wherein said interconnection system further comprises first abutment member adjustment means connected with said extension member for selectively locating said first abutment member with respect to said second abutment member.

10. The desk top extension device of claim 5, wherein said interconnection system further comprises a second abutment member connected with said bottom side of said base member, said abutment member being structured to abut opposite sides of the front of the drawer when said bottom side of said base member abuts the top front edge of the drawer so as to prevent said base member from being moved in said plane with respect to the desk, said second abutment member being located with respect to said base member so that a collective center of gravity of said base member and said interconnection system is located between said outer end of said base member and said abutment member.

11. The desk top extension device of claim 5, wherein said interconnection system further comprises a second abutment member connected with said bottom side of said base member, said second abutment member being structured to abut the front of the drawer when said bottom side of said base member abuts the top front edge of the drawer so as to prevent said base member from being moved in said plane inwardly toward the desk, said second abutment member being located with respect to said base member so that a collective center of gravity of said base member and said interconnection system is located between said outer end of said base member and said second abutment member.

12. The desk top extension device of claim 11, wherein said first abutment member is located with respect to said second abutment member so that simultaneously said first abutment member substantially abuts the outer side of the upper drawer frame member when said second abutment member substantially abuts the drawer so as to prevent said base member from being moved in said plane with respect to the desk.

13. The desk top extension device of claim 12, wherein said interconnection system further comprises first abutment member adjustment means connected with said extension member for selectively locating said first abutment member with respect to said second abutment member.

14. The desk top extension device of claim 11, wherein said interconnection system further comprises first abutment member adjustment means connected with said extension member for selectively locating said first abutment member with respect to said second abutment member.

15. The desk top extension device of claim 1, wherein said interconnection system further comprises an abutment member connected with said bottom side of said base member, said abutment member being structured to abut opposite sides of the front of the drawer when said bottom side of said base member abuts the top front edge of the drawer so as to prevent said base member from being moved in said plane with respect to the desk, said abutment member being located with respect to said base member so that a collective center of gravity of said base member and said interconnection system is located between said outer end of said base member and said abutment member.

16. A method for connecting a desk top extension device to a desk, the desk top extension device including a base member and an extension member connected to one end of the base member, the desk top extension member further having a center of gravity, the desk having a top surface defining a horizontal plane, the desk having at least one drawer, the desk further having an upper drawer frame member located immediately above the at least one drawer, the at least one drawer having a width and a top front edge, said method comprising the steps of:

partly opening a drawer of the desk;

inserting the extension member into the drawer;

resting the base member upon the top front edge of the drawer while simultaneously placing the extension member abutably upon the upper drawer frame member so that the base member is held in an orientation substantially parallel with respect to the horizontal plane; said step of partly opening the drawer further comprising locating the center of gravity of the desk top extension member between the other end of the base member and the top front edge of the drawer.

17. The method of claim 16, wherein the desk top extension device further includes a first abutment member connected with a remote end of the extension member; wherein said step of placing further comprises locating the first abutment member abutably against the upper drawer frame member so as to prevent the base member from moving outwardly from the desk.

18. The method of claim 16, wherein the desk top extension device further includes a second abutment member connected with the base member; wherein said step of resting further comprises locating the second abutment member abutably against the drawer adjacent the top front edge thereof so as to prevent the base member from moving inwardly toward the desk.

19. The method of claim 16, wherein the desk top extension device further includes a second abutment member connected with the base member; wherein said step of resting further comprises locating the second abutment member abutably against the upper drawer frame member so as to prevent the base member from moving inwardly toward the desk.

* * * * *